US008042691B2

(12) United States Patent
Brosseuk et al.

(10) Patent No.: US 8,042,691 B2
(45) Date of Patent: Oct. 25, 2011

(54) HEAVY PARTICLE SEPARATION

(75) Inventors: Raymond Brian Brosseuk, Revelstoke (CA); Greig Oppenheimer, New York, NY (US)

(73) Assignee: IE-TEC Licensing Limited, Port Louis (MU)

( * ) Notice: Subject to any disclaimer, the term of this patent is extended or adjusted under 35 U.S.C. 154(b) by 303 days.

(21) Appl. No.: 10/551,890

(22) PCT Filed: Apr. 2, 2004

(86) PCT No.: PCT/IB2004/050386

§ 371 (c)(1), (2), (4) Date: Aug. 11, 2006

(87) PCT Pub. No.: WO2004/087325

PCT Pub. Date: Oct. 14, 2004

(65) Prior Publication Data

US 2007/0017853 A1 Jan. 25, 2007

(30) Foreign Application Priority Data

Apr. 3, 2003 (ZA) ..... 2003/2617

(51) Int. Cl.
*B07B 1/06* (2006.01)

(52) U.S. Cl. ..... 209/274; 209/12.1

(58) Field of Classification Search ..... 209/12.1, 209/18, 44.2, 268, 691, 692, 428–430, 497, 209/506, 274–283
See application file for complete search history.

(56) References Cited

U.S. PATENT DOCUMENTS

| | | | | | |
|---|---|---|---|---|---|
| 46,806 | A | * | 3/1865 | Kustel | 209/429 |
| 409,091 | A | * | 8/1889 | Adams | 209/429 |
| 470,781 | A | * | 3/1892 | Cudner | 209/429 |
| 682,749 | A | | 9/1901 | Roberts | |
| 964,083 | A | * | 7/1910 | Blake | 209/429 |
| 1,736,111 | A | | 11/1929 | Davidson | |
| 4,505,811 | A | | 3/1985 | Griffiths et al. | |
| 5,108,584 | A | | 4/1992 | Brosseuk | |
| 6,059,120 | A | * | 5/2000 | Rohr et al. | 209/428 |

FOREIGN PATENT DOCUMENTS

| | | | |
|---|---|---|---|
| FR | 1.123.805 | | 9/1956 |
| GB | 1 487 429 | * | 9/1977 |

* cited by examiner

*Primary Examiner* — Joseph C Rodriguez
*Assistant Examiner* — Kalyanavenkateshware Kumar
(74) *Attorney, Agent, or Firm* — Merchant & Gould P.C.

(57) ABSTRACT

A method of heavy particle separation, including a primary separation stage which includes the steps of dropping, accumulating, concentrating and discharging of heavy particles and/or a secondary separation stage for concentrating heavy particles which includes the steps of infeeding, stilling and retaining such particles.

33 Claims, 4 Drawing Sheets

HEAVY PARTICLE SEPARATION

INTRODUCTION

This invention relates to heavy particle separation. More particularly, this invention relates to a method and apparatus i.e. a system for heavy particle separation or recovery from ore, gravel, earth, and the like.

BACKGROUND TO THE INVENTION

The inventor is aware of a variety of apparatus and processes that have been used for extracting heavy particles, such as gold, platinum, lead and the like, from ore, gravel or sand, earth, including placer ore for example in respect of alluvial gold, and the like. Such apparatus and methods suffer from certain problems including an inability to deal with a broad range of particle sizes and a failure to recover fine particles. This reduces the efficiency and hence the profitability of such recovery systems.

Another disadvantage is that certain recovery systems involve the use of large quantities of water. Such large quantities of water are not always available at a site where, for example, gold-bearing placer ore is found and processed. Even in localities where large quantities of water are available, such usage can impact negatively on the environment, and hence large holding ponds or holding tanks are required.

Another disadvantage of conventional placer ore recovery systems is that a surge is created in water flowing through the system with each new load of gravel that is added to the system. This results in loss of fine gold particles.

Further disadvantages of for example existing gold recovery systems include an extended clean-up time and a large volume of concentrate which add significantly to the cost of operations; the large size of equipment; high capital cost and difficulty of transporting such equipment.

The inventor is also aware of the apparatus and process disclosed in his U.S. Pat. No. 5,108,584, which was granted and published on 28 Apr. 1992. This patent describes an outer and inner barrel arrangement. The inner drum has an upper fragmentation section, an intermediate trommel section and a lower discharge section. A spray of water is directed into the inner barrel. The ore is separated into large tailings that are discharged from the lower end of the inner drum and fine, light tailings from the outer drum. Heavy, fine portions of the material are carried by a spiral on the inside surface of the outer drum and discharged into the upper end of a sluice box from the upper end of the outer drum. The sluice box includes the plurality of landings upon which heavy material, such as gold, collect. The outer drum may be vibrated to assist in the recovery process.

OBJECTS OF THE INVENTION

An object of the present invention is to overcome, at least partly, the shortcomings or disadvantages associated with the prior art systems.

Another object of the present invention is to provide an apparatus and method which are both novel and include an inventive step

SUMMARY OF THE INVENTION

According to one aspect of the present invention, there is provided a method of heavy particle separation, including a primary separation stage which includes the steps of dropping, accumulating, concentrating and discharging of heavy particles and/or a secondary separation stage for concentrating heavy particles which includes the steps of infeeding, stilling and retaining such particles.

The method may include a preliminary separation stage.

The preliminary separation stage may include the steps of adding water to the feed material, scrubbing, size classification and transportation to the primary separation stage.

The preliminary separation stage may include a differential transportation step designed to separate heavy, medium and light particles before introduction to the primary separation stage.

The primary separation stage may include transporting particles including heavy particles between the dropping, accumulating and concentrating steps in the primary separation stage.

Heavy particles may be discharged from the accumulation zone and collected or fed to the secondary separation stage.

Particles from the discharge zone may be collected or fed to the secondary separation stage.

Particles discharged from the discharge zone may be separated into a leading section, a central section, and a trailing section before being collected or fed to the secondary separation stage.

Particles including heavy particles may be transported between the infeeding, stilling and retaining steps of the secondary separation stage.

According to another aspect of the present invention, there is provided a heavy particle separation apparatus, including a tiltable, transverse belt concavely shaped in its central area, and including a spiral rib having any suitable pitch provided on the belt outer surface, the rib being adapted to urge material upwardly along the transverse belt, a material feeder means provided above the transverse belt and a water spray system also provided above the conveyor belt.

When used in this specification, the expression 'transverse belt', means a conveyor belt in which the belt travels in a direction transverse to the general flow of material provided thereon (and not in the same direction as is the case with conventional conveyor belts).

The apparatus may include a plurality of idler rollers adjustable in a vertical direction to provide any desired profile for the transverse belt.

The apparatus may include a classification system to provide the material feeder means with material smaller than about 2.5 cm.

The material feeder means may include a feed conveyor belt and/or sloping chute so that it provides an even differentiated feed of material to the transverse belt.

The material feeder means may be provided above the transverse belt operated conveyor belt and near one side thereof.

The water spray system may be provided above and near the opposite side of the transverse belt to the material feeder means.

The rib may be replaced by a groove having any suitable pitch and/or the belt surface may have any suitable texture. The rib or groove, as applicable, may have a suitable varying pitch along its length; and may have a suitable varying height or depth, as applicable, along its length The apparatus may include a suitable tailings trough at the lower end of the transversely operated conveyor belt and a suitable concentrate trough at the upper end thereof.

The concentrate trough may lead to a secondary separation means comprising a suitable sluice box to separate fine heavy material.

According to yet another aspect of the present invention, there is provided a method of separating heavy particles, including the step of using an apparatus as herein described.

DETAILED DESCRIPTION OF THE INVENTION

The invention will now be described in greater detail, by way of non-limiting example, with reference to the following drawings, in which.

Figure 1:
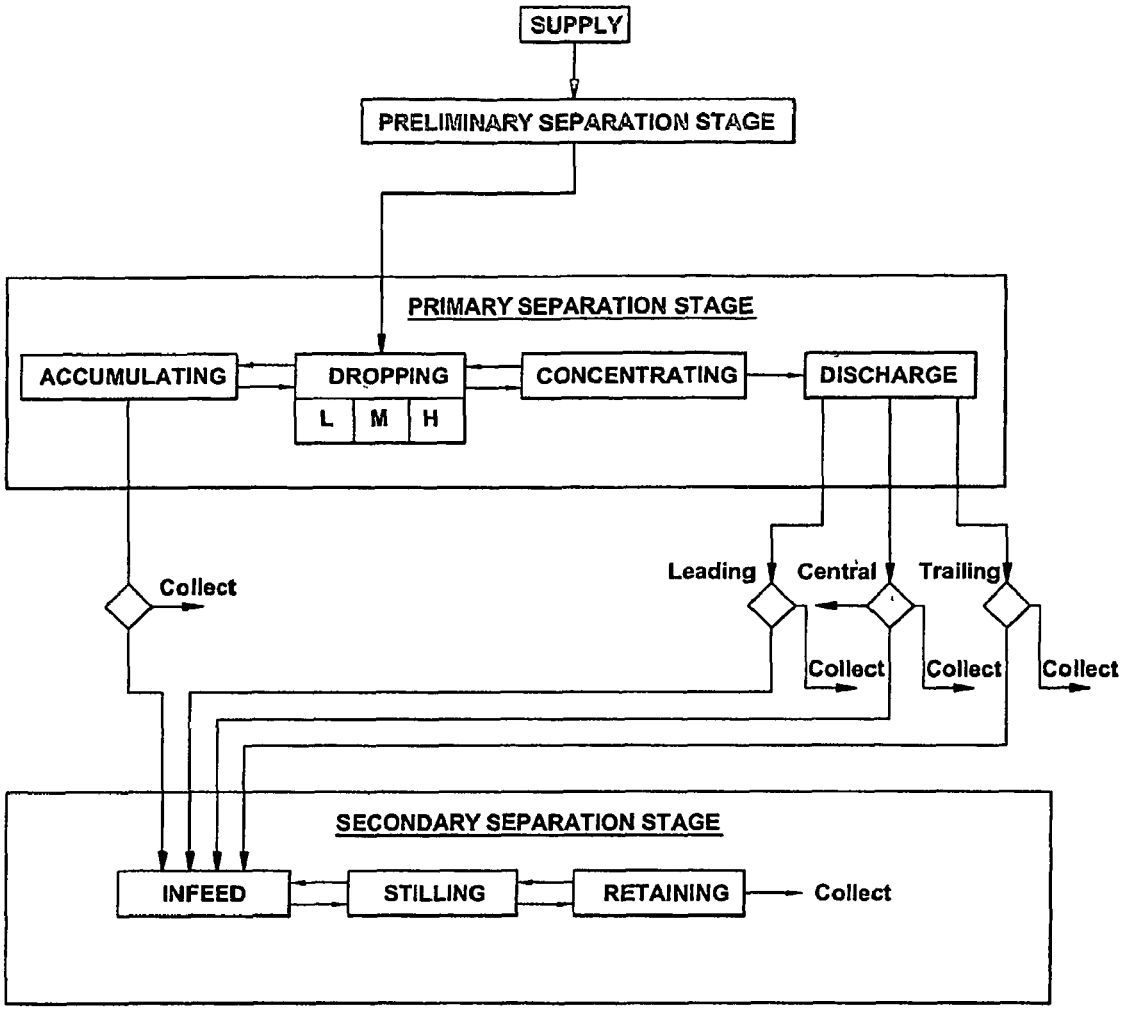
FIG. 1 shows a schematic flow diagram of the method of heavy particle separation, according to one form of the present Invention.
Figure 3:
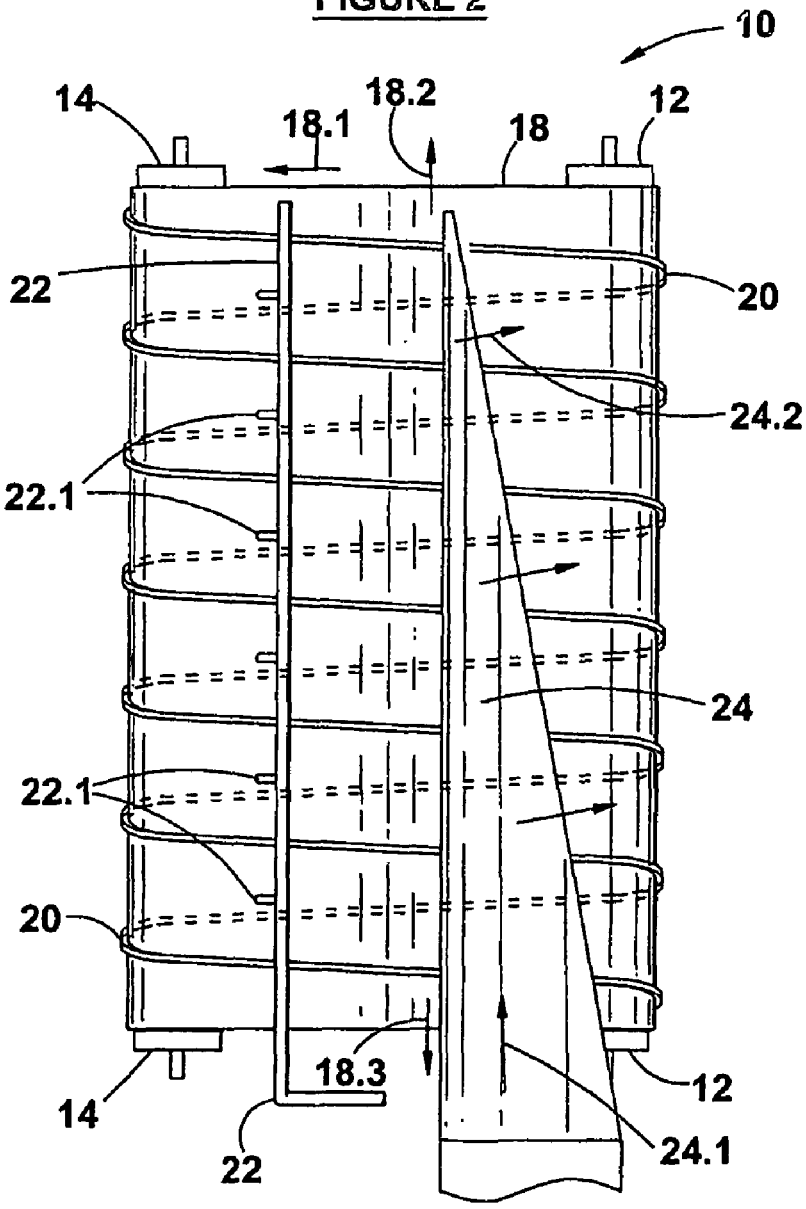
FIG. 3 shows an upper plan view of the apparatus of FIG. 1, also shown schematically.
Figure 5:
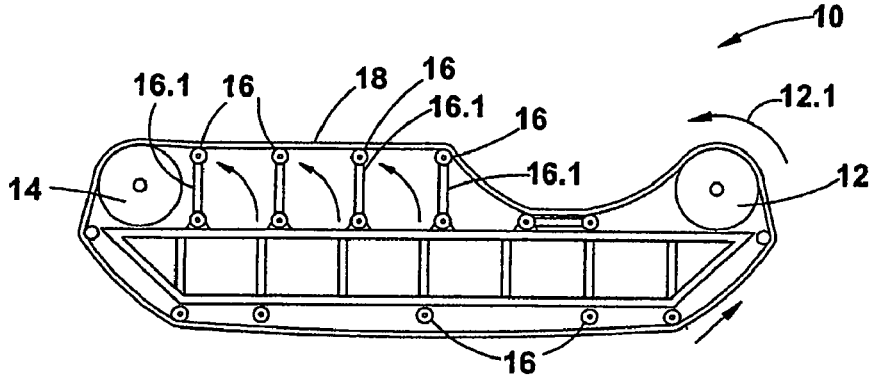
Figure 6:
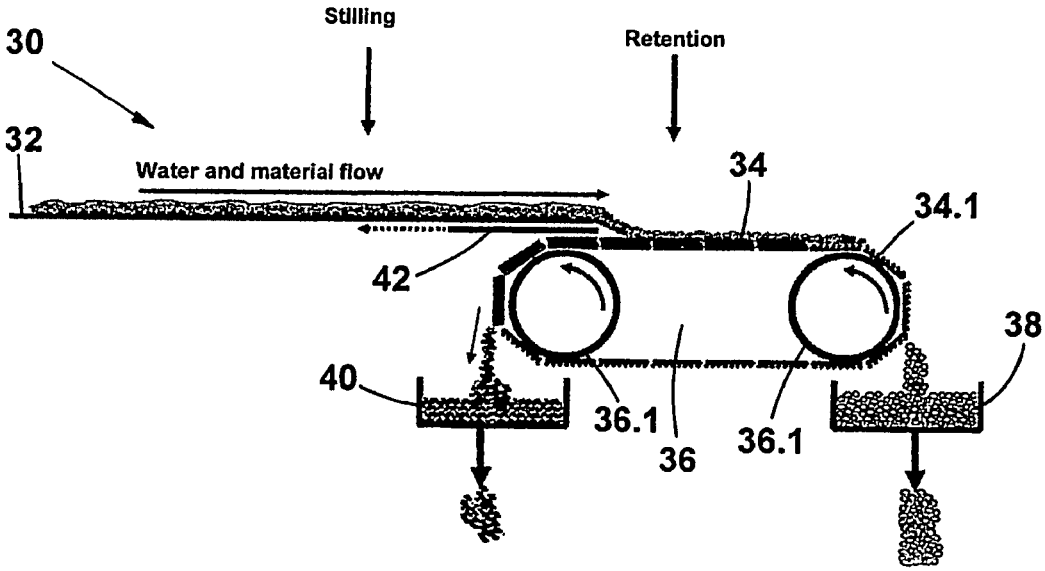
Figure 7:
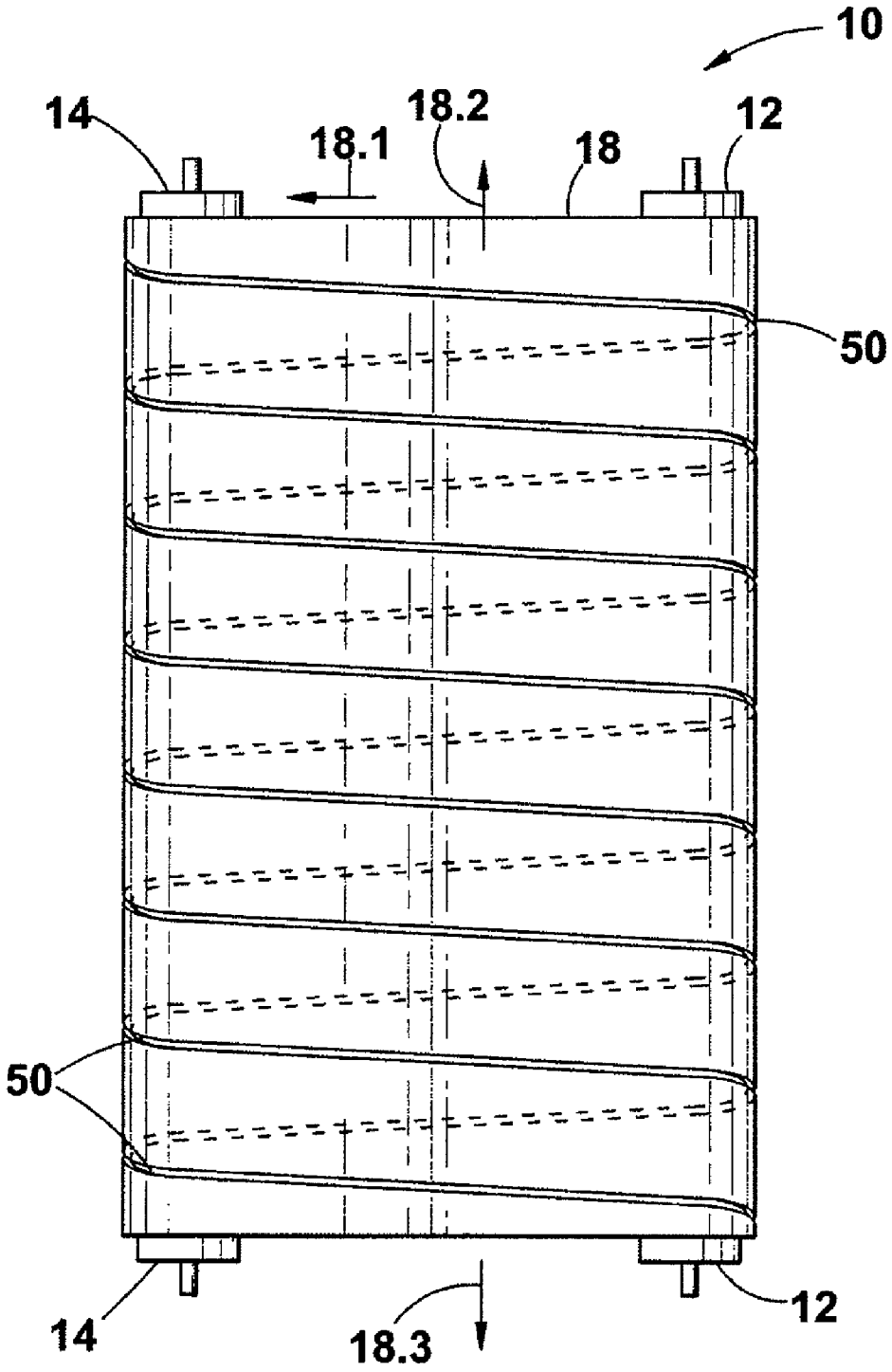

FIG. 5 shows an end view of the apparatus of FIG. 3 with the conveyor belt having a different concave section, also shown schematically; and FIG. 6 shows a schematic side view of part of an apparatus forming a secondary separation stage, according to one form of the present invention; and FIG. 7 shows a schematic upper plan view of the apparatus of FIG. 1, and in particular shows a spiral groove in the place of the preferred spiral rib, on the belt.

In the drawings, like reference numerals refer to like parts, unless otherwise indicated.

Referring firstly to FIG. 1, a flow diagram is shown, indicating one form of the method of heavy particle separation, according to the invention.

The method, as shown in FIG. 1, indicates that material containing heavy particles such as ore, alluvial gravel, or even processed material, is supplied or introduced firstly to a preliminary separation stage. Although not shown, this stage includes the steps of adding water to the material for scrubbing and transportation throughout the process. Such scrubbing has the effect of liberating mineral particles/heavy particles. The preliminary separation stage also includes the step of size classification to ensure that oversize (undesirable) material (larger than, for example, 2.5 cm) is removed from the process (after having been scrubbed).

The preliminary separation stage further includes the step of being fed into or supplied to the primary separation stage by using a suitably designed conveyor belt or a conveyor belt and chute system which is tilted and tapered to a point along its inner edge which in itself provides a preliminary separation of light, medium and heavy particles. The light particles are urged to flow along the inner edge toward the point of the belt or chute whilst the heavy particles are urged to move towards and travel along the outer edge and the shorter part of the belt or chute, thereby achieving a preliminary separation of light, medium and heavy particles.

Particles which are separated as described above are then fed to the primary separation stage which will be described in greater detail hereunder.

The primary separation stage includes the step of dropping, accumulating, and concentrating, with each of these steps taking place in a particular zone, which will also be described more fully hereunder.

In the dropping zone, dropping of material takes place (from the aforementioned chute and for example on to a transverse belt, both of which will be explained in greater detail hereunder).

In the dropping zone, medium to heavy and some low density particles will settle to the lowest level and will be transported in spiral fashion up to the concentration zone. In the upper section of the dropping zone, a certain amount of recombination of heavier particles with low density particles will take place.

Medium to low density particles will be exposed to turbulent water action or scouring in spiral fashion whilst some of the ultra fine (water-suspended) particles will be washed down to the lower section of the drop zone and transported to the accumulation zone.

Water-scoured low density particles and ultra-fine (water-suspended) particles will tend to be washed from the concentration zone toward and into the dropping zone by water in a rolling/turbulent fashion.

In the accumulation zone which is located downwardly from the dropping zone, material is introduced by means of scouring from the dropping zone. In this zone, accumulation takes place typically behind a retention lip or rim and gravity settlement takes place within a retained mass. Medium to high density particles are drawn back in spiral fashion to the dropping zone by means of a so-called transport wedge of material pushed ahead of a spiral rib, for example.

In this zone, as in the other zones, water scouring of light and ultra-fine material takes place over the spirally moving rib, i.e. on the transverse belt.

Any material swept or washed over the lower edge of the accumulation zone is caught in an adjustable (collection) tray from where it may be collected or fed to a secondary separation stage for further treatment of ultra-fine particles.

It should be understood that in all zones, the mix or ratio of material depends on various operating parameters (which may in turn depend on apparatus settings) such as inclination of the transverse belt speed, material feed rate, the spiral height, water flow, and the like as well as the characteristics of the feed material, and the like.

Particles that are transported to the concentration zone from the dropping zone include particles having a variety of densities but more particularly high, high and medium density particles.

Essentially gravity settlement takes place within a retained mass, particularly as far as heavy and medium density particles are concerned. However, water scouring in spiral, turbulent/rolling fashion takes place in respect of some of the low density particles and ultra-fine (water-suspended) particles are lifted and transported back down to the dropping zone. In other words, in the concentration zone, although the primary process is settlement of heavy and medium density particles, a measure of scouring of low density and fine fraction particles takes place which are returned to the dropping zone.

The general operation of this process has the effect that light particles are moved downwardly to the accumulation zone where they are removed whilst heavier particles are transported upwardly by the transverse belt to the concentration zone from where they are discharged.

Finally, discharge of high and medium and some low density particles takes place at the upper end of the concentration zone i.e. in the discharge zone. Material is swept and/or washed into one or more adjustable (collection) trays from where they are collected or transported to the secondary separation stage. By using a spiral separation mechanism and optimal water flow, it is possible to provide an even flow rate of material and to avoid surging of discharge material.

Material which is discharged from the discharge zone can be collected accordingly by the aforementioned adjustable collection trays in three sections namely a leading section, a central section, and a trailing section, each of which can be collected or fed to and processed by the secondary separation stage, as shown in FIG. 1. As with material from the accumulation zone, such material can be collected, i.e. separated from material to be further processed, i.e. for separation in the secondary separation stage.

Depending on certain factors, material may be separated by using the first separation stage alone, or by using the second separation stage alone, or these two stages maybe combined. The secondary separation stage may include the steps of infeeding, stilling, retention, and collection of concentrate.

The infeeding step may include transporting material introduced into the collection trays to a stilling plate. Infeeding facilitates layering and its velocity is chosen so as to achieve a density separation of particles.

In the stilling step, a suitable stilling plate is provided so that material is spread to facilitate layering and even material flow. This leads to layering of material densities and flow velocities are used to ensure that high density particles form a lower layer with a lower flow velocity whilst low density particles form an upper layer with a higher flow velocity.

This step requires that stilling time and design is sufficient to ensure that material and water or other fluid flow is predominantly laminar (instead of turbulent) to optimise retaining or retention of high density particles in the final phase of the secondary separation.

The next step is a retaining step and the aforementioned particles are fed into the retaining zone where multiple flow velocities are created. Rolling, vortex flow causes heavy particles to drop into catchment spaces and light particles are scoured out of such catchment spaces. Consequently gravity settlement of heavy particles takes place to the lower layers of catchment spaces. At the same time scouring of the upper/light particles takes place. Retention of heavy particles takes place in such catchment spaces which allows for collection and removal of such particles.

Collection of concentrate may be carried out manually in batch mode or in an automatic, continuous manner. In this step, catchment spaces may be partially or fully filled with heavy particles during the aforementioned retaining step. Catchment spaces are preferably shielded from water flow and withdrawn from the retaining zone. Catchment spaces are washed into final concentrate collection containers and the containers are removed from the secondary separation stage.

It will therefore be seen that the invention provides a comprehensive and thorough separation method for heavy density particles whether large or small in size.

The aforementioned method may for example and preferably be carried out by means of the apparatus which is described in greater detail hereunder.

Figure 2:
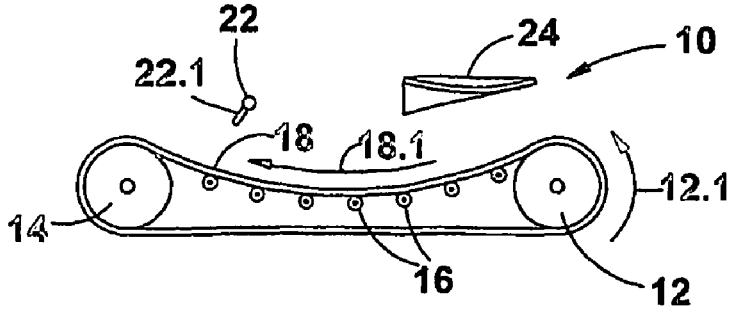
FIG. 2 shows an end view of part of a heavy particle separation apparatus shown schematically, according to one form of the present invention forming a primary separation stage.

Referring next to FIGS. 2 and 3, reference numeral 10 refers generally to a heavy particle separation apparatus, shown in schematic form, according to one form of the invention.

The apparatus 10 includes a head or driven roller 12 and a tail roller 14. The roller 12 is driven or rotated by a suitable motor or engine (not shown) through an adjustable speed gearbox (also not shown) which enables the head roller to be driven at a suitable speed, depending on various factors. The rollers 12 and 14 are journalled in suitable bearings (not shown) which in turn are supported by a suitable frame (also not shown) that supports the rollers 12 and 14 and hence the apparatus 10.

A transverse belt 18 is operatively mounted on the rollers 12 and 14, and preferably made from a base layer of rubber having a thickness of approximately 40 mm having a top coat of food-grade polyurethane thereon of about 10 mm thickness. The belt 18 has a continuous spiral rib 20, having any suitable pitch provided thereon, which may be made of rubber, pvc, a suitable polymer, or any other suitable material. In another form of the invention, the belt 18 may be provided without a rib 20 but may instead be provided with a spiral groove of any suitable pitch. In yet another form of the invention, the surface of the belt may be provided with any suitable texture. Although not shown, the rib 20 or groove may have a suitable varying pitch along its length; and the rib 20 or groove may have a suitable varying height or depth, as applicable, along its length.

A plurality of idler rollers 16 are provided between the rollers 12 and 14, in a concave array to support the belt 18 concavely between the rollers 12 and 14, as shown in FIG. 2.

When being set up for use, the belt 18 will have its one end i.e. the lower end as shown in FIG. 3, tilted above the horizontal i.e. upwardly out of the plane of the drawing, thereby providing an upper and a lower end. At the lower end, the first two spirals of the rib 20 as shown in the drawing may be doubled to about 80 mm in height whilst for the rest of the rib 20, the height will be approximately 40 mm in height.

A water supply pipe 22 is provided along the one side of the belt 18, including a plurality of downwardly pointing spray nozzles 22.1 intended to spray water on the upper surface of the conveyor belt 18 and thereby to lubricate the surface of the belt 18 and to assist in transportation of particles along the belt surface.

Provided above and along the opposing side of the belt 18 is an ore feeder means in the form of a downwardly tilted or sloped channel-shaped chute 24 which will feed ore including heavy particles In the direction shown firstly by the arrow 24.1 and then by the arrow 24.2 onto the surface of the belt 18.

The apparatus 10 includes other component parts such as a tailings trough (not shown) to receive concentrate shown by the arrow 18.3 at the upper end of the belt 18. The concentrate trough leads to a sluice box (also not shown) for example, and these parts will be discussed hereunder.

In one form of the invention, in order to process large quantities of material, for example about 200 tons per hour, the apparatus 10 may have the following dimensions:

Each of the rollers 12 and 14 may be about 60 cm in diameter, the overall width of the belt 18 may be about 5 m and the length of the conveyor belt may be about 7.5 m, with the rotational speed of the rollers 12 and 14 being about 40 rpm. The angular inclination of the apparatus 10 may be about 3 to 6 degrees from the horizontal.

Figure 4:
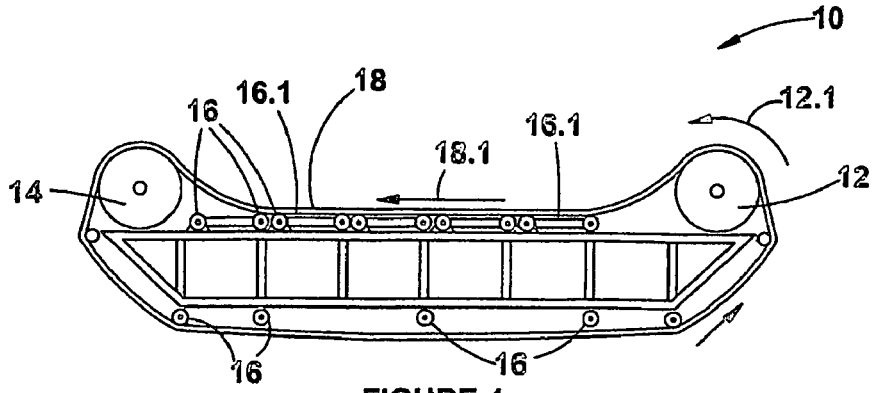
FIG. 4 shows an end view of another heavy metal recovery apparatus shown schematically, according to another form of the present invention.

Referring next to FIGS. 4 and 5, idler rollers 16 are shown, essentially to support the belt 18 along its upper run or to space the belt from the support frame of the apparatus and thereby to prevent damage to the belt 18 along its lower run. In FIG. 3 the idler rollers 16 are shown in a lower position to provide the belt 18 and hence the apparatus 10 with a maximum capacity of about 600 tons per hour. It will be seen that each idler roller 16 is mounted on an adjustable arm 16.1 which may be pivoted and thereby raised to a vertical position (as shown in FIG. 4) to provide a different concave profile for the belt 18 i.e. to provide a smaller concave profile which can for example deal with a minimum capacity of about 50 tons per hour. The adjustable arms 16.1 are secured by means of suitable brackets and nuts and bolts (not shown) to the belt support framework as shown in FIGS. 4 and 5.

For this capacity and this belt profile, the water supply pipe 22 may be moved accordingly to the right hand side of the drawing to ensure that the water nozzles 22.1 provide water operatively in the concave section of the belt 18, as shown in FIG. 5.

Referring lastly to FIG. 6, reference numeral 30 refers generally to part of the apparatus constituting the secondary separation stage. An infeeding conveyer (not shown) is connected to a stilling plate 32 which in turn is connected to a retaining/retention plate 34 which contains a plurality of retaining modules 34.1. These may be removed for collection of concentrate on a manual batch basis. Alternatively, and as shown in FIG. 6, the retaining modules 34.1 are mounted removably on a suitable conveyer means in the form of a caterpillar-type track 36 having a roller-driven system 36.1.

A light particle collection trough 38 is positioned under the track 36 on its right hand side and a heavy particle collection trough 40 is positioned under the track 36 on its left hand side. A shield 42 is provided under the plate 32 to shield the modules 34.1 from water flow. The shield 42 is retractable and covers the modules 34.1 as these are moved away from the material and water flow and around the track 36. The shield 42 then springs back over the next module 34.1.

In use, the apparatus 10 is operated as set out hereunder.

Material containing heavy particles, or alluvial gravel for example, is first classified in any manner known in the prior art to produce gravel or particles having a size less than 1 inch or less than about 2.5 cm (in other words a fraction size of minus 1 inch). This material is then fed in the direction shown by arrow 24.1 along the chute 24 onto the belt 18 as shown by the arrows 24.2. The belt 18 is driven by the roller 12 which in turn is rotatably driven in the direction indicated by arrow 12.1.

Hence the belt 18 is driven in the direction indicated by arrow 18.1 at a speed determined by the rotational speed of the rollers 12 and 14 which are rotated at about 40 rpm.

Water from the nozzles 22.1 on the pipe 22 spray water downwardly onto the belt 18, and such water will be provided in counter-current fashion both because it will flow contrary to the direction of the arrow 18.1 due to the concave shape of the belt 18 and contrary to the general flow downwardly because the belt 18 is tilted upwardly at the lower end of the drawing in FIG. 2

The spiral rib 20 will tend to move the material upwardly along the slope i.e. upwardly along the belt 18 whilst water sprayed from the nozzles 22.1 will flow counter-current to such flow i.e. downwardly along the slope of the belt 18.

This will result in waste moving downwardly i.e. light weight particles of gravel or stones moving downwardly in the direction of the arrow 18.2 whilst heavy concentrate will tend to move upwardly along the belt, urged by the spiral rib 20 and as shown by the arrow 18.3 to exit the belt 18 at its upper end at the site of the arrow 18.3 into a concentrate trough (not shown). Light weight particles of gravel or stones will move downwardly in the direction of arrow 18.2 and exit the belt 18 at the site of the arrow 18.2 into a tailings trough (also not shown).

Generally speaking, larger nuggets and particles of heavy material, such as gold, will be trapped ahead of the spiral 20 and such particles, including fine particles of material, will be washed by water sprayed onto the belt 18 from the nozzles 22.1 back into the concave or hollow part of the belt 18 and will move in the direction indicated by the arrow 18.2.

Consequently, concentrate, which generally speaking will amount to about 5% in alluvial gold mining and upwards of 50% in hard rock ore of the total volume of ore fed onto the belt 18, will exit the belt as shown by the arrow 18.3.

When the concentrate leaves the belt as shown by the arrow 18.3, it will drop into the concentrate trough (not shown) from where it will be fed into a sluice box (also not shown) or other suitable means forming a secondary separation stage, where the heavy metal, for example gold, will be suitably separated from the fine material.

Treatment of material by the apparatus 10 may provide sufficient separation of heavy particles. Alternatively, when used on its own the apparatus 30 may provide sufficient separation, when used as described above. A further alternative is to use the apparatus 10 and the apparatus 30 in tandem, as may be required.

In this manner, the apparatus 10, and the associated method will produce a high recovery rate of heavy metal, for example gold, typically in excess of about 98 or even 99%.

Although not shown, the belt 18 and the rollers 12 and 14, and the frame on which these are mounted, can conveniently be mounted on a mobile trailer which can be transported by rail and/or by road. Either such trailer may conveniently have a suitable jacking means at one end (not shown) to elevate or tilt the conveyor belt suitably or alternatively, the framework may have its own jacking or tilting means (also not shown) to provide the necessary gradient for the apparatus 10 and hence for the belt 18.

It will therefore be seen that a novel and inventive method and apparatus i.e. system is provided for recovering heavy mineral particles, such as gold, from ore, gravel, or the like, in a simple and an efficient manner which requires minimal water consumption. Naturally the water used on the belt may be recycled after settling or filtration, as may be required. Similarly the water used in the sluice box may also be recycled, as appropriate.

The method and apparatus of the invention therefore provide a relatively inexpensive and cost-efficient system for recovering or separating heavy minerals from ore, gravel, or the like, relative to existing or prior art systems. Although certain embodiments only of the invention have been described and/or exemplified herein, it will be apparent to any person skilled in the art that other possibilities, modifications and/or variations of the invention are possible. Such possibilities, modifications and/or variations are therefore to be considered as falling within the spirit and scope of the invention as herein claimed and/or described or exemplified.

The invention claimed is:

1. A method of separating heavy particles from light particles comprising:

dropping particles onto a transversely operated belt that is moved in a direction transverse to the direction of movement of particulate material;

accumulating a first group of particles having substantially medium to low density;

concentrating a second group of particles having substantially medium to high density, concentrating comprising:

providing a variably adjustable concave profile in the belt, the concave profile being progressively adjustable from a first position wherein the belt is in a fully lowered cross-sectional configuration to a second position wherein the belt is in a fully raised cross-sectional configuration and to positions intermediate between the first position and the second position; and subjecting the first and second groups of particles to separation in the concave area, each in an opposite direction; and discharging each of the groups at an opposite end of the belt.

2. The method of claim 1, further comprising:

infeeding the concentrated second group of particles to a stilling plate;

stilling the particles on the stilling plate; and feeding the particles into a retaining zone and retaining the particles.

3. The method of claim 2, further comprising transporting particles comprising heavy particles between infeeding, stilling, and retaining.

4. The method of claim 1, further comprising using a spiral formation provided on the belt to provide effective heavy particle separation.

5. The method of claim 4, wherein the spiral formation provides effective heavy particle separation in one or more of the following ways:

moving particles transversely to the belt movement;

fluidising the particles so that light particles are scoured off from its upper layer and heavy particles are drawn back toward the upper end of the belt;

providing increased retention time for material on the belt resulting in repetitive and more accurate evaluation of the relative densities of the particles.

6. The method of claim 1, further comprising:

adding water to the feed material;

scrubbing;

classifying by size; and transporting the the particles for dropping.

7. The method of claim 1, wherein transporting comprises differential transportation designed to separate heavy, medium and light particles before dropping.

8. The method of claim 1, further comprising transporting particles comprising heavy particles between the dropping, accumulating, and concentrating.

9. The method of claim 1, wherein discharging comprises discharging heavy particles from an accumulation zone; and the method further comprises collecting or feeding the discharged particles to a secondary separation stage.

10. The method of claim 1, further comprising collecting or feeding particles from a discharge zone to a secondary separation stage.

11. The method of claim 1, further comprising separating particles discharged from a discharge zone into a leading section, a central section, and a trailing section;

and collecting or feeding the separated particles to a secondary seperation stage.

12. The method of claim 1, wherein the variable concave profile of the belt is progressively adjustable from a first position, wherein the belt is cross-sectionally symmetrical, to an intermediate position, wherein the belt is cross-sectionally asymmetrical.

13. The method of claim 1, comprising the concave profile being variable from a first position that spans the transverse direction of the belt to an intermediate position that spans only a minor portion of the transverse direction of the belt, in which the minor portion can be disposed to a side of the belt.

14. The method of claim 1, comprising providing a plurality of adjustable idler rollers located below an upper run of the belt, each in a fully lowered orientation in which the belt is in the first position.

15. The method of claim 1, comprising providing a plurality of adjustable idler rollers located below an upper run of the belt, each in a fully raised orientation in which the belt is in the second position.

16. The method of claim 1, comprising providing a plurality of adjustable idler rollers located below an upper run of the belt, wherein the belt is in an intermediate position with both raised and lowered idler rollers.

17. A heavy particle separation apparatus, comprising a tiltable transverse belt, the tiltable transverse belt:

being configured to be moved in a direction transverse to the direction of movement of particulate material;

being concavely shaped in its central area and having a plurality of idler rollers adjustable in a vertical direction to provide a variable concave profile in the belt; the concave profile being progressively adjustable from a first position wherein the belt is in a fully lowered cross-sectional configuration to a second position wherein the belt is in a fully raised cross-sectional configuration and to positions intermediate between the first position and the second position; and comprising a continuous spiral formation having an effective pitch provided on the belt outer surface; the spiral formation being configured to urge material upwardly along the belt;

a material feeder disposed above the belt;

a water spray system disposed above the belt; and exit points for particulate material.

18. The apparatus of claim 17, further comprising a classification system to provide the material feeder with material smaller than about 2.5 cm.

19. The apparatus of claim 17, wherein the material feeder comprises a feed conveyor belt, sloping chute, or feed conveyor belt and sloping chute so that it provides an even differential feed of material to the transversely operated transverse belt.

20. The apparatus of claim 19, the material feeder being provided above the transversely operated transverse belt and near one side thereof.

21. The apparatus of claim 20, wherein the water spray system is provided above and near an opposite side of the transversely operated transverse belt with respect to the material feeder.

22. The apparatus of claim 17, in which the spiral formation is a rib or a groove having an effective pitch; the belt surface has an effective texture; or the spiral formation is a rib or a groove having an effective pitch and the belt surface has an effective texture.

23. The apparatus of claim 22, wherein the rib or groove has a suitably varying pitch along its length.

24. The apparatus of claim 22, wherein the rib or groove has a suitably varying height or depth, respectively, along its length.

25. The apparatus of claim 17, further comprising:

a tailings trough at the lower end of the transversely operated transverse belt; and a concentrate trough at the upper end of the transversely operated transverse belt.

26. The apparatus of claim 25, wherein the concentrate trough leads to a sluice box to separate fine heavy material.

27. The apparatus of claim 17, further comprising retaining or retention modules mounted on a conveyer and being removable in continuous fashion for collection of heavy particles.

28. The apparatus of claim 17, wherein the variable concave profile of the belt is progressively adjustable from a first position, wherein the belt is cross-sectionally symmetrical, to an intermediate position, wherein the belt is cross-sectionally asymmetrical.

29. The apparatus of claim 17, wherein the concave profile is variable from a first position that spans the transverse direction of the belt to an intermediate position that spans only a minor portion of the transverse direction of the belt, in which the minor portion can be disposed to a side of the belt.

30. The apparatus of claim 17, comprising a plurality of adjustable idler rollers located below an upper run of the belt.

31. The apparatus of claim 30, wherein when each of the plurality of adjustable idler rollers is in a fully lowered orientation, the belt is in the first position.

32. The apparatus of claim 30, wherein when each of the plurality of adjustable idler rollers is in a fully raised orientation, the belt is in the second position.

33. The apparatus of claim 30, wherein when the apparatus comprises both raised and lowered idler rollers, the belt is in an intermediate position.

* * * * *